United States Patent [19]

Hayes et al.

[11] Patent Number: 5,011,103

[45] Date of Patent: Apr. 30, 1991

[54] LEAF BAG AND COLLAPSIBLE FRAME

[75] Inventors: Franklin A. Hayes; Harold E. Sexton, both of Asheboro, N.C.

[73] Assignee: A.R.T. of Asheboro, Ltd., Asheboro, N.C.

[21] Appl. No.: 505,936

[22] Filed: Apr. 5, 1990

[51] Int. Cl.[5] ..... B65B 67/00

[52] U.S. Cl. ..... 248/99; 248/95

[58] Field of Search ..... 248/95, 97, 98, 99, 248/100, 101

[56] References Cited

U.S. PATENT DOCUMENTS

| | | | |
|---|---|---|---|
| 3,240,457 | 3/1966 | Backlund et al. | 248/99 |
| 3,697,030 | 10/1972 | Schultz | 248/101 |
| 3,747,653 | 7/1973 | Ringer | 248/99 X |
| 3,754,785 | 8/1973 | Anderson | 248/99 X |
| 3,774,081 | 7/1973 | Miller | 248/101 |
| 3,934,803 | 1/1976 | Paulus, Jr. | 248/99 |
| 3,998,415 | 12/1976 | D'Antonio et al. | 248/101 |
| 4,006,928 | 2/1977 | Beugin | 248/99 X |
| 4,023,842 | 5/1977 | Harvey | 248/99 |
| 4,355,725 | 10/1982 | Humphrey | 211/182 X |
| 4,664,348 | 5/1987 | Corsaut, III et al. | 248/99 |
| 4,749,011 | 6/1988 | Rylander | 248/99 |
| 4,759,519 | 7/1988 | Cheng | 248/99 |
| 4,768,742 | 9/1988 | Kaaloa | 248/99 |
| 4,832,292 | 5/1989 | Beckham | 248/99 |

*Primary Examiner*—David L. Talbott

*Attorney, Agent, or Firm*—Rhodes, Coats & Bennett

[57] ABSTRACT

A collapsible frame supports a leaf bag in such a position that a portion of the bag rests horizontally on the ground and the remainder of the bag is so attached to the frame so as to present a large arch-shaped opening to facilitate the collection of leaves, grass trimmings and other garden and lawn debris. The arch is formed by an overhead, resilient rod member inserted through an overhead receiving hem or fabric tunnel in or adjacent the perimeter of entrance to the bag. A pair of elongated rigid stabilizing feet are placed along the ground within the entrance to the bag. The ends of the overhead rod member are then inserted in an upwardly facing support cavity on each stabilizing foot. The overhead member forms an arcuate hoop or arch which supports the opening of the bag in a generally upright plane, with the remainder of the bag extending horizontally and parallel to the stabilizing feet. In a preferred embodiment, a second horizontal loop is secured at each end to a rearwardly facing cavity or passageway in each stabilizing foot. An intermediate portion of the horizontal hoop is attached to the floor of the bag to help retain the bag in a stretched out condition and maintains the arch member in close proximity to the floor.

8 Claims, 1 Drawing Sheet

LEAF BAG AND COLLAPSIBLE FRAME

BACKGROUND OF THE INVENTION

This invention relates to leaf collection and, more specifically, to a bag and frame combination for use in yards that facilitates the collecting and discarding of leaves, grass trimmings, and other garden and lawn debris by a single workman.

DESCRIPTION OF THE PRIOR ART

Large plastic or other fabric bags are widely used for collecting and discarding leaves, grass trimmings and other garden and lawn debris. However, plastic or other flexible collection bags are extremely pliable. As such, it is difficult for a single worker to both hold the mouth of the bag open and to rake leaves into the bag or otherwise fill it. Some attempts have been made to provide frames for temporarily supporting the bag with the mouth open.

The following patents are hereby referenced as being typical of known prior art insofar as they disclose other devices for holding the mouths of such bags open while the bags rest horizontally.

| Patent No. | Inventor |
|---|---|
| 4,759,519 | Wen H. Cheng |
| 4,749,011 | Nicholas M. Rylander |
| 4,664,348 | Otho O. Corsaut, III et al. |
| 3,744,081 | Ann Miller |
| 4,832,292 | William T. Beckman |
| 4,768,742 | Edward P. Kaaloa |
| 4,006,928 | Louis E. Beugin |

Cheng discloses a rectangular frame which only collapses with a degree of difficulty and presents an impediment to raking the leaves into the bag. Rylander discloses a pliable sheet which is rolled up into a substantially cylindrical configuration and inserted inside the bag, whereby the bag is kept open by the sheet's tendency to flatten out. This device is not collapsible and does not provide any means for securing the bag to the ground or preventing it from rolling with use. Corsaut, III discloses a plastic strip with operation similar to a cross-section of the device in Rylander. Miller discloses a collapsible and adjustable three-sided frame to be inserted in the bag's mouth which presents an impediment of the raking or sweeping of debris into the bag. It does not include any provision to prevent the apparatus from toppling over. The other references are illustrative of other approaches.

The present invention is described to another and a different approach that works quite well. It utilizes a simple, inexpensive, easily collapsible, lightweight frame and a bag so constructed as to cooperate with the frame to present a collection bag with a large open mouth that remains steady and stationary during filling, yet is quite easily moved or the bag removed for dumping or disposal.

In general, the bag/frame combination of the present invention combines a flexible container having an open end which, when assembled, forms an entrance having a minor substantially straight portion and a major arcuate portion having a rod receiving tunnel. The frame is formed by a collapsible rod member that, when assembled, extends through the tunnel, and a pair of spaced stabilizing feet that support the rod in an upright arched position and maintains the bag in an open position. The rod, however, is flexible and, since there is no rigid connector between the feet when the bag is full, the feet may be selectively urged together to hold the bag closed as it is carried to a dump site.

In the preferred embodiment, the frame includes a second, horizontal arch member that (a) helps to hold the frame upright, and (b) holds the bag floor in a flat extended position. In an alternate smaller embodiment, a disposable bag is assembled to the frame which includes only a single rod in the vertical and horizontal arch.

Accordingly, it is a general object of this invention to provide a bag and frame combination which supports the bag in an open state while the bag rests horizontally, so as to facilitate the collection of leaves, grass trimmings and other garden and lawn debris in the bag.

It is a further object of this invention to provide such a frame which constitutes an improvement over prior art in terms of being inexpensive, lightweight, easily assembled and disassembled, and which provides means for supporting the bag for stabilizing the frame, for presenting a large arch-shaped opening to the worker, and for keeping the bag extended.

It is a further object of this invention to provide a bag and frame combination which constitutes an improvement over prior art approaches in satisfactorily holding the bag in the frame during vigorous use and which allows the bag to be easily closed and transported with the frame inside.

It is a further object of this invention to provide a disposable frame for disposable bags whereby, after collection, the bag may be easily removed from the frame, the bag and its contents disposed of and another bag attached to the frame, or the bag may be emptied and reattached to the frame.

SUMMARY OF THE INVENTION

A flexible, rod-like, arch member is inserted through a rod receiving tunnel that extends throughout a major portion of the periphery near the perimeter of the bag's opening. A pair of elongated, rigid stabilizing feet, are placed in spaced parallel arrangement to each other adjacent each end of the tunnel within the mouth of the bag. The ends of the arch member are then inserted in an upwardly facing support cavity on each stabilizing foot. The arch member thus forms an arcuate hoop which supports the opening of the bag in a generally upright plane. The remainder of the bag extends horizontally and rearwardly along an axis parallel to the stabilizing feet. In the preferred embodiment, a second horizontal arch member is secured at each end to the stabilizing feet. An intermediate portion of the second arch extends through a loop in the floor of the bag to retain it in a stretched out position and maintain it in close proximity to the bag floor.

In a second embodiment, the size of the frame is reduced by using only a single rod in the upright arch and in the horiziontal arch. An adjustable cord between the feet enables a single worker to pull the feet together, hold them there, emplace the bag with both hands, then release the cord allowing the feet to spread to the operable position. A disposable bag is seated on the frame with the opening surrounding the upright and and the adjustable cord. The cord forms an excellent sill over which the bag edge is folded.

DETAILED DESCRIPTION OF THE INVENTION

The present invention is directed to a collapsible support frame for leaf and trash bags suitable for receiving leaves, grass, garden and lawn debris and other trash. In one embodiment (FIGS. 1–3), the bag is large and reusable. In a second embodiment (FIG. 4), the bag is smaller and disposable. When assembled for use on the frame, the bag presents a large open mouth into which leaves and debris may be swept or raked.

In the one embodiment, a resuable bag includes features designed specifically for optimal use with the disclosed frame. In the second embodiment, other configurations, of the bags, even disposable bags with drawstrings, may also be effectively used on the frame.

Figure 1:
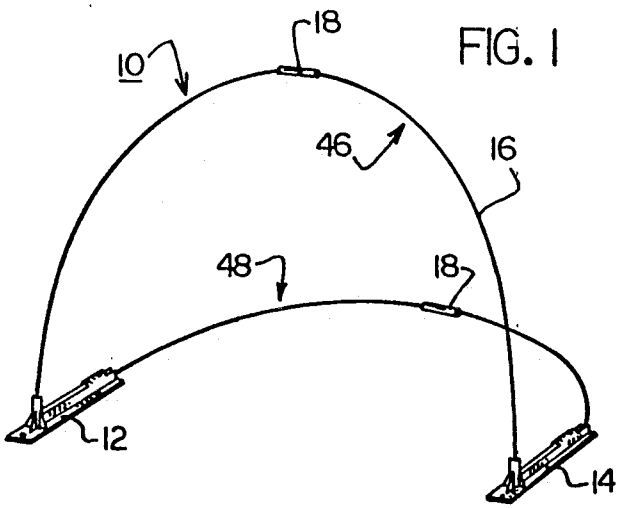
FIG. 1 is a perspective view of the assembled frame.
Figure 2A:
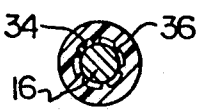
FIG. 2A is a sectional view taken substantially along lines 2A—2A in FIG. 2.
Figure 2B:
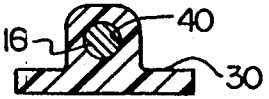
FIG. 2B is sectional view taken substantially along lines 2B—2B in FIG. 2.
Figure 2:
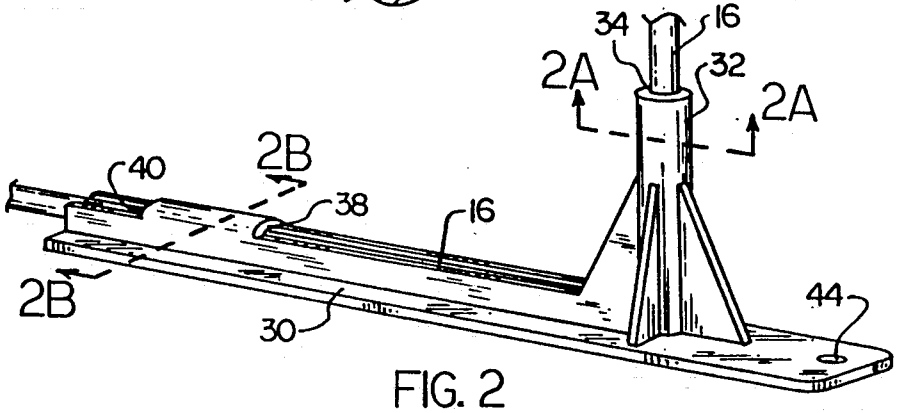
FIG. 2 is a perspective view of the stabilizing foot 46.

Referring now more particularly to FIG. 1 of the accompanying drawings, the collapsible frame 10 includes a pair of stabilizing feet 12, 14 which are arranged in spaced relation to each other and support a plurality of flexible rods 16 therebetween. Some of the rods 16 are connected by a sleeve 18 and form a substantially upright arch 46 extending between the two stabilizing feet 12, 14. Others of the rods 16 are connected by a sleeve 18 and form the horizontal arch 48 extending between the rear ends of stabilizing feet 12, 14. The resulting frame 10 then utilizes the horizontal arch which helps to maintain the frame erect and serves to keep the bag floor spread. The upright arch supports a major portion of the bag, to be described hereinafter, and forms a large open mouth into which leaves, trash or other debris may be swept or raked.

The stabilizing feet 12, 14 are identical and, therefore, only one will be described. First of all, the stabilizing foot 12 is formed of a suitable, moldable material such as metal or polymeric resins, however, preferred construction is talc-filled polypropylene. The foot 12 includes an elongated base member 30. An upstanding rod receiving seat 32 extends upwardly from a point adjacent the front end of body member 30. An opening or cavity 34 extends downwardly into seat 32 and actually receives one end of one of rods 16. The cavity may include longitudinally extending, flexible teeth 36 which run at least a portion the length of the cavity to provide a frictional gripping means to better hold and stabilize the end portion of the rod 16 received therein. A horizontally extending, rod receiving tunnel 38 is positioned near the rear end of the body member 30 and also includes a horizontal opening or cavity extending therethrough which grips and seats the end portion of one of rods 16 as will be described hereinafter. Cavity 40 may also lined with resilient teeth or fingers 36 extending the length of the inner surface thereof to provide frictional engagement of the rod. An opening 44 is provided at the extreme front end of and through the body member 30. Opening 44 serves a dual purpose. In some uses. it may be desired to secure the stabilizing foot 16 to the ground. In such a case, a peg or stake is inserted through opening 44, so that the stabilizing foot will not move across the ground. In other installations, as will be described hereinafter, the frame 10 may be utilized in conjunction with a disposable bag. In which case, the opening 44 may provide an anchor for a connecting cord between the stabilizing feet 12, 14.

Figure 3:
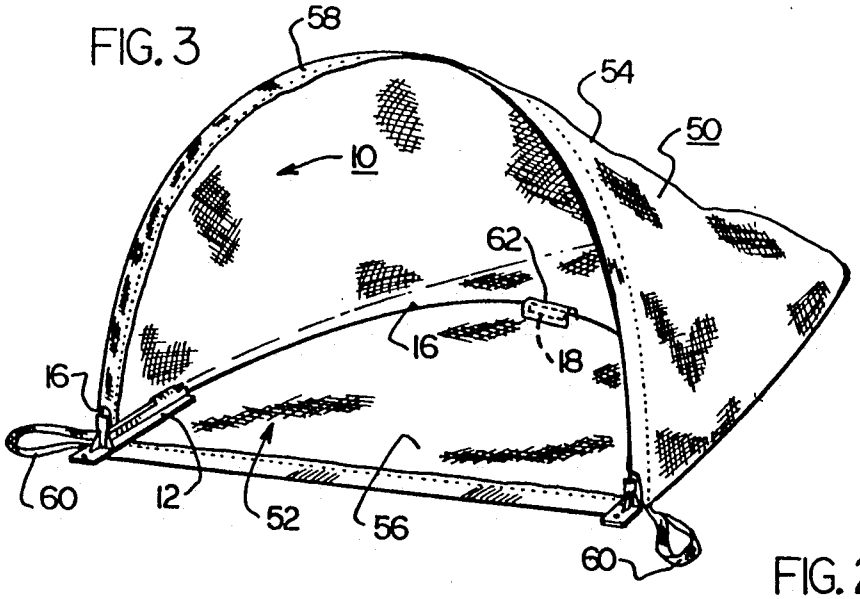
FIG. 3 is a perspective view of the frame of FIG. 1 with a reusable container seated thereon.

Turning now to FIG. 3, bag 50 is illustrated assembled onto frame 10. The bag 50 is formed of an extremely pliable material, for example, nylon. The mouth or opening 52 of the bag is divided into a major portion 54 and a minor portion 56. The major portion 54 is provided with a hem 58 in the form of a fabric tunnel. A pair of strap handles 60 are preferably attached to the minor portion of the periphery and extend forwardly therefrom. Finally, a fabric loop or tunnel 62 is sewn on the interior wall of the bag at a point spaced from the minor portion 56 of the periphery 52 and at a point approximately equidistant between the ends of the minor portion 56.

The assembly of the bag/frame combination is best illustrated in FIG. 3. First of all, two of the rods 16 are connected by one of the sleeves 18, then threaded through the hem 58 around the major portion of the periphery of the bag opening. A second pair of rods 16 are connected by sleeve 18 to form the horizontal arch or hoop 48. The ends of the rod 16 which form the upright arch 46 are then flexed to form a substantially semi-circular configuration, and the ends of the rods are inserted into the vertical cavities of the stabilizing feet 12, 14. Thus, the stabilizing feet will assume a position approximately at the ends of the hem opening separated by the minor portion 56 of the bag opening. The rear end of the feet 12, 14 and horizontal arch will have been inserted into the bag, and the rod assembly forming the horizontal arch 48 will then be flexed and inserted through the loop 62 and into the horizontal tunnel 38 at the rear end of the stabilizing feet 12, 14. The bag is then ready for use with the stabilizing feet and horizontal arch 48 forming a stand for the bag which keeps it upright. The vertical arch 46 presents a large opening into which leaves and debris may be swept or blown.

When the bag is filled, the handles 60 are grasped by the worker and the entire bag 50 of debris, including where the leaves are intended to be dumped and deposited. Because the rods 16 are flexible and there is no rigid connector between feet 12, 14, it can be seen that the feet come together when the bag is lifted and the mouth closed by pulling strap handles together. After dumping, the bag and frame are returned, set up in a new desired position and filled, wherein the procedure repeates.

Figure 4:
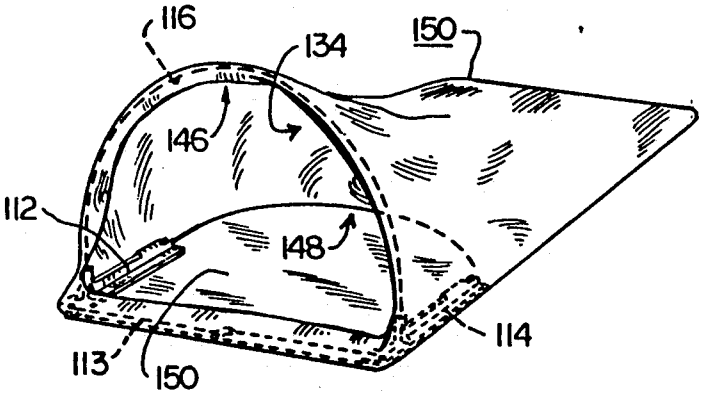
FIG. 4 is a respective view of an alternative embodiment in which the frame size is reduced and a disposable bag is releasbly seated thereon.

Looking at FIG. 4, there is illustrated an alternate embodiment in which the collection bag 150 is disposable. Further, the bag 150 is preferably of a polymeric film material and available on the open market as a leaf or lawn bag. A conventional size has a capacity of 39 gallons with a diameter of 33 inches and a length of 38 inches. This bag fits snugly on the frame illustrated in FIG. 4. The frame 110 again includes a plurality of stabilizing feet 112, 114, an upright arch 146, and a horizontal arch 148 which serve to maintain the stand erect and to present a large opening into which leaves and debris may be swept. In the embodiment of FIG. 4, however, it is preferred that only one rod 116 be used for the upright arch 146 and one rod 116 be used for the horizontal arch 148. Each rod is approximately 48 inches long. When the ends of the rod forming the upright arch 146 are flexed and assembled into the wells or cavities 134 of the upstanding seat 132, a flexible cord or connecting member 113 is attached between the openings 144 in the stabilizing feet 112, 114. This retains the feet 112, 114 in the proper laterally spaced positions and limits the natural tendency of the feet to spread responsive to the bias exerted by arch 146.

Once the frame is erected, the disposable bag 150 is attached around the frame and the drawstring pulled tight. The feet 112, 114 may be drawn together slightly to facilitate seating of the bag, then when released the feet will then tend to move further apart securely seating the bag 150. The cord 113 also forms a convenient sill over which a small section of the bag is folded to facilitate the raking and filling operation. It should be pointed out that it is necessary that the opening in the bag be no less than the perimeter of the frame formed by the upright arch 146 and the distance between stabilizing feet 112. While this embodiment has described a disposable bag which is, of course, smaller than the flexible reusable bag illustrated in FIGS. 1–3, this approach functions quite well as a means for filling disposable bags.

Some alternative configurations come to mind. For example, it is believed that the horizontal arch 48 and 148 can possibly be eliminated, although it is preferred to ensure that the rear ends of the stabilizing feet do not tend to rotate inwardly toward each other. Also, the stabilizing feet may be molded in many different types of configurations, even to the extent that a ground engaging protrusion might be provided.

While two embodiments have been described in detail hereinabove, it is apparent that various changes and modifications might be made without departing from the scope of the present invention which is set forth in the accompanying claims.

What is claimed is:

1. A trash and leaf collection container comprising:

(a) a flexible bag-like container having an open end and a closed end, said open end having a minor portion and a major arcuate portion, a rod receiving means extending around said major arcuate portion;

(b) a self-supporting frame for receiving said open end of said flexible container and comprising:

(i) an arch lying in a substantially upright plane formed by a rod means extending through said rod receiving means with the central portion thereof flexed and the opposite ends of said rods means protruding downwardly and outwardly of each end of said rod receiving means;

(ii) a pair of spaced elongated stabilizing feet, each of said stabilizing feet being placed at one end of said minor portion and extending into said bag in a direction parallel to the longitudinal axis thereof, means associated with each of said feet for connecting one end of said rod means thereto and maintaining said arch in said vertical plane;

(c) whereby said flexible bag-like container with its rod receiving means cooperates with said stabilizing feet to establish and maintain the trash and leaf collection container in an open upright position without any supplemental struts extending from said arch into said container which interfere with the filling and emptying of said container.

2. A trash and leaf collection container according to claim 1 including a second supporting arch lying in a horizontal plane and formed by a second rod means, the central portion of which is flexed and the ends thereof being connected to said stabilizing feet, said stabilizing feet and horizontal arch cooperating to form a support means for maintaining said frame in an upright condition.

3. The trash and leaf collection container according to claim 2 wherein said each of said rod means comprise a plurality of flexible rod members joined by a connecting sleeve.

4. The trash and leaf collection container according to claim 2 wherein said flexible container includes a loop on the inner surface thereof for receiving the mid-portion of said horizontal arch and maintaining it in connection with said collection container.

5. The trash and leaf collection container according to claim 2 wherein each of said stabilizing feet include a molded polymeric member having an upstanding seat with a cavity therein for receiving one of the ends of said vertical arch and a horizontal tunnel member on the upper surface thereof adjacent the rear end thereof for receiving one end of said horizontal arch member.

6. A frame for use in combination with a trash and leaf collection bag comprising:

(a) an upright arch formed of a first flexible rod having the central portion thereof flexed and curved in an arcuate shape and lying in a substantially upright plane with the opposite ends of said rod extending downwardly;

(b) a pair of elongated stabilizing feet, each of said stabilizing feet including a first means for receiving one end of said first rod which forms said upright arch and a second means for receiving a second rod which extends in a second plane;

(c) a second, substantially horizontal arch formed of a second flexible rod means having the central portion thereof flexed and curved in an arcuate shape, the ends of which are inserted into said second rod receiving means in said stabilizing feet;

(d) whereby said stabilizing feet and said horizontal arch form a base for said frame, and said stabilizing feet and said upright arch form a bag supporting means which, when assembled, retains a bag in an open upright position, with a large opening thereinto without any supplemental struts extending from said upright arch into the bag which interfere with the filling and emptying of the bag.

7. The frame according to claim 6 and further including an adjustable cord attached to and extending between said pair of stabilizing feet, said cord serving to limit the distance between said stabilizing feet.

8. The frame according to claim 6 wherein said first receiving means comprises an upstanding seat having an upwardly opening cavity therein and said second receiving means comprises a generally horizontally extending tunnel positioned near the rear end of each of said stabilizing feet.

* * * * *